US006764388B2

(12) United States Patent
Liu et al.

(10) Patent No.: US 6,764,388 B2
(45) Date of Patent: Jul. 20, 2004

(54) HIGH-PRESSURE PAD CLEANING SYSTEM

(75) Inventors: Ying-Chih Liu, Hsin-Chu (TW); Jackson Hsu, Taichung (TW); Island Ho, Taichung (TW); Ben Liu, Hsinchu (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 101 days.

(21) Appl. No.: 10/143,197

(22) Filed: May 9, 2002

(65) Prior Publication Data

US 2003/0211816 A1 Nov. 13, 2003

(51) Int. Cl.[7] ..... B24B 1/00; B24B 7/00
(52) U.S. Cl. ..... 451/56; 451/72; 451/443
(58) Field of Search ..... 451/21, 56, 57, 451/60, 65, 72, 443, 444, 446

(56) References Cited

U.S. PATENT DOCUMENTS 5,578,529 A * 11/1996 Mullins ..... 438/692
5,702,563 A * 12/1997 Salugsugan et al. ..... 438/692
5,851,138 A * 12/1998 Hempel, Jr. ..... 451/56
6,116,993 A * 9/2000 Tanaka ..... 451/287
6,168,502 B1 * 1/2001 Allman et al. ..... 451/38
6,200,207 B1 * 3/2001 Hsu ..... 451/443
6,241,587 B1 * 6/2001 Drill et al. ..... 451/56
6,283,840 B1 * 9/2001 Huey ..... 451/288

* cited by examiner

*Primary Examiner*—Timothy V. Eley
(74) *Attorney, Agent, or Firm*—Tung & Associates

(57) ABSTRACT

A high-pressure pad cleaning system that can be used in conjunction with semiconductor device fabrication tools that utilize pads, such as chemical-mechanical polishing (CMP) tools, is disclosed. A system includes a turntable, first and second outlets, and a dresser. A pad is placed on the turntable, where the turntable rotates in a first direction. The first outlet supplies a dressing solution, such as deionized water, onto the pad at a first pressure, substantially at a single point on the center of the pad. The second outlet supplies the solution onto the pad at a second pressure greater than the first pressure, substantially at a radial line from the center of the pad to its edge at an angle and in a direction opposite to the first direction.

19 Claims, 4 Drawing Sheets

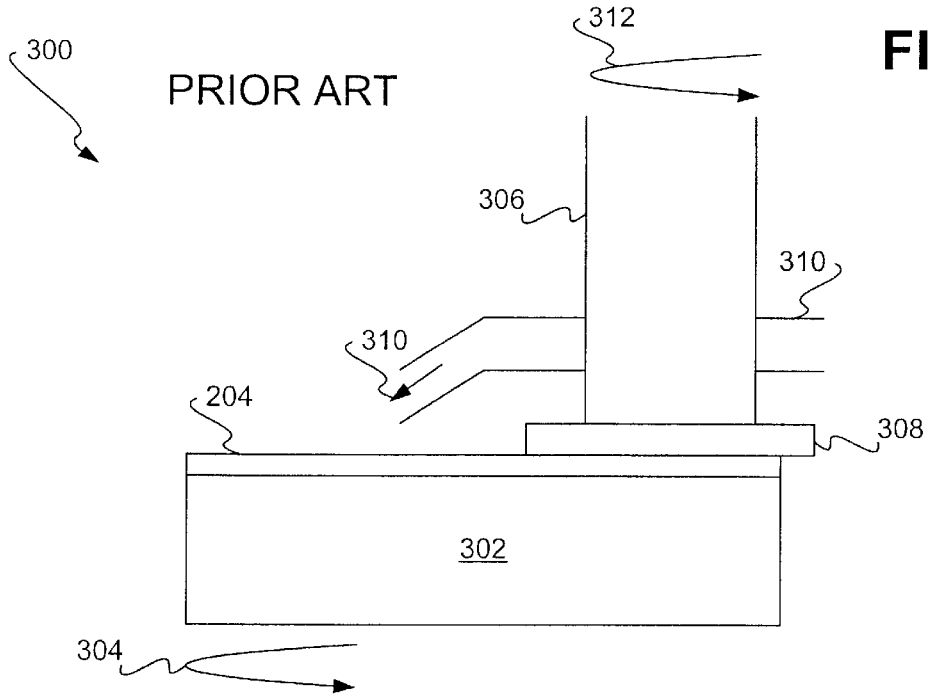
FIG 3
FIG 4
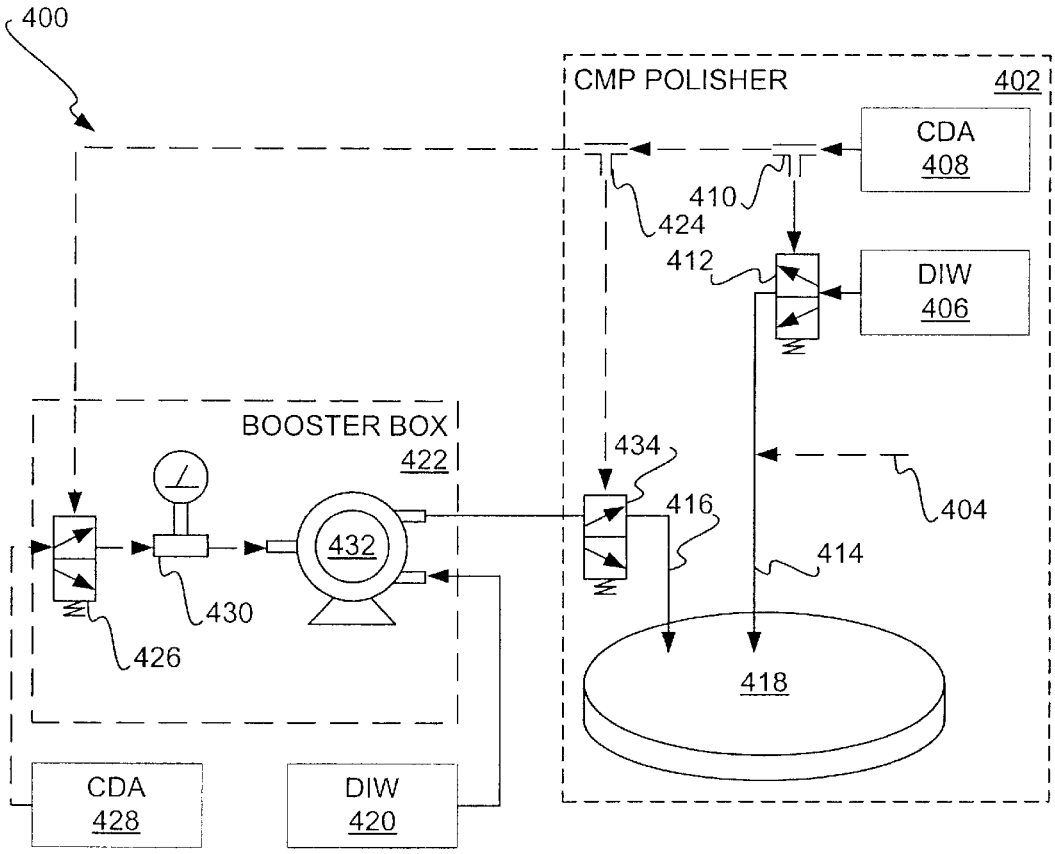

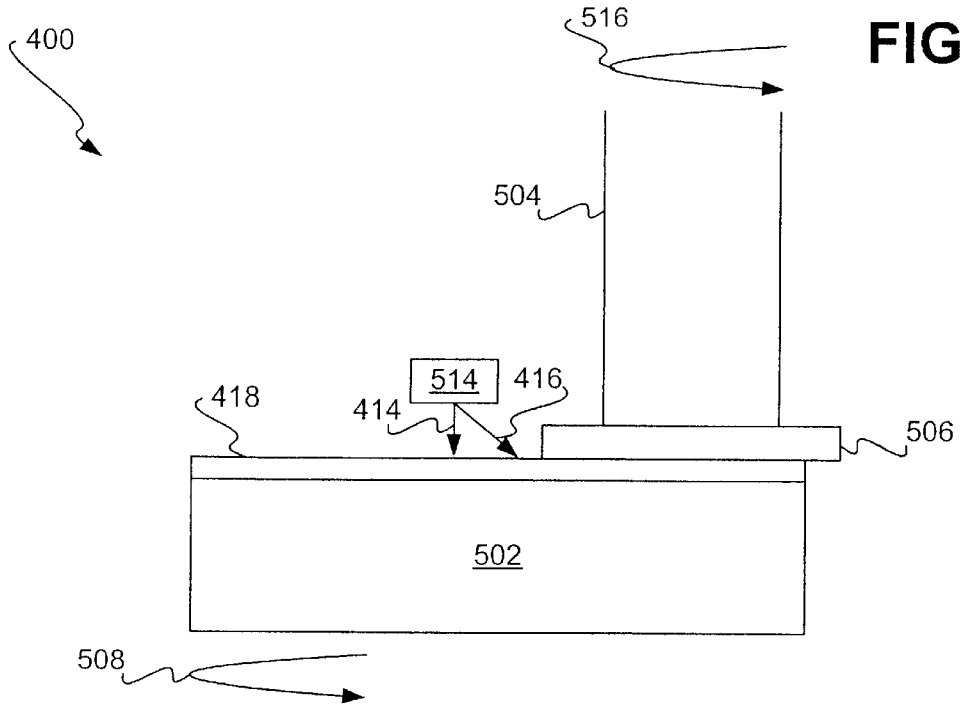
FIG 5A
FIG 5B
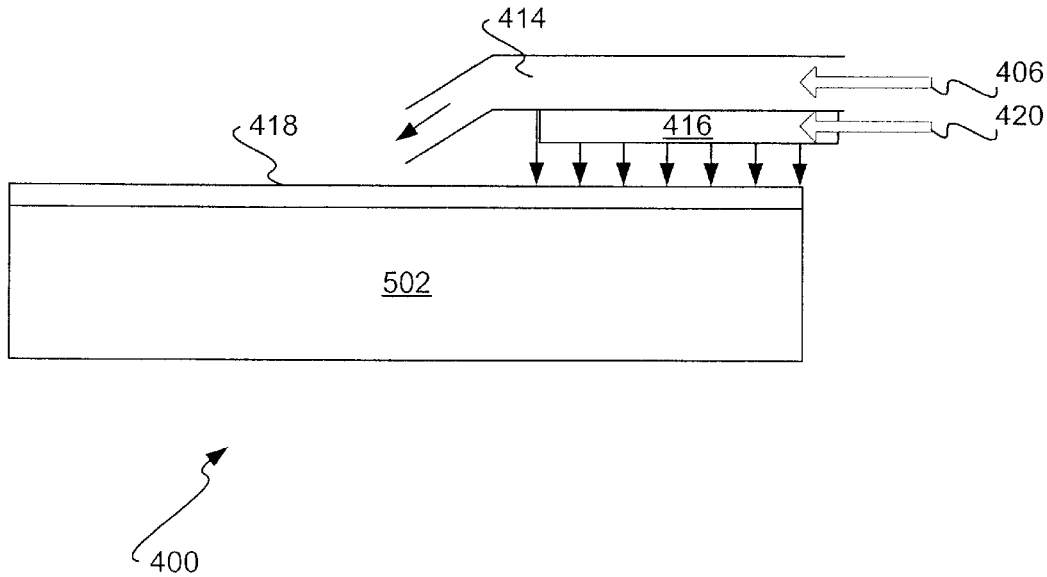

HIGH-PRESSURE PAD CLEANING SYSTEM

FIELD OF THE INVENTION

This invention relates generally to pads used in semiconductor device fabrication, such as in chemical-mechanical polishing (CMP), and more particularly to cleaning such pads.

BACKGROUND OF THE INVENTION

Chemical mechanical polishing (CMP) is a semiconductor wafer flattening and polishing process that combines chemical removal with mechanical buffing. It is used for polishing and flattening wafers after crystal growing, and for wafer planarization during the wafer fabrication process. CMP is a favored process because it can achieve global planarization across the entire wafer surface, can polish and remove all materials from the wafer, can work on multi-material surfaces, avoids the use of hazardous gasses, and is usually a low-cost process.

FIGS. 1A and 1B show an example effect of performing CMP. In FIG. 1A, a semiconductor wafer 102 has a patterned dielectric layer 104, over which a metal layer 106 has been deposited. The metal layer 106 has a rough top surface, and there is more metal than necessary. Therefore, CMP is performed, resulting in FIG. 1B. In FIG. 1B, the metal layer 106 has been polished down so that it only fills the gaps within the dielectric layer 104.

FIG. 2 shows an example CMP system 200 for polishing the wafer 102 of FIGS. 1A and 1B. The wafer 102, with its dielectric layer 104 and metal layer 106, is placed on a platen 202 connected to a rotatable rod 206. A polishing pad 204 is lowered over the wafer 102, specifically over the metal layer 106 thereof. The polishing pad 204 is also connected to a rotatable rod 206. Slurry 210 is introduced between the polishing pad 204 and the metal layer 106, and the polishing pad 204 is lowered, pressured against the metal layer 106, and rotated to polish away the excess, undesired metal from the metal layer 106. The platen 202 is rotated as in the opposite direction. The combined actions of the two rotations and the abrasive slurry 210 polish the wafer surface.

The polishing pad 204 can be made of cast polyurethane foam with fillers, polyurethane impregnated felts, or other materials with desired properties. Important pad properties include porosity, compressibility, and hardness. Porosity, usually measured as the specific gravity of the material, governs the pad's ability to deliver slurry in its pores and remove material with the pore walls. Compressibility and hardness relate to the pad's ability to conform to the initial surface irregularities. Generally, the harder the pad is, the more global the planarization is. Softer pads tend to contact both the high and low spots, causing non-planar polishing. Another approach is to use flexible polish heads that allow more conformity to the initial wafer surface.

The slurry 210 has a chemistry that is complex, due to its dual role. On the mechanical side, the slurry is carrying abrasives. Small pieces of silica are used for oxide polishing. Alumina is a standard for metals. Abrasive diameters are usually kept to 10–300 nanometers (nm) in size, to achieve polishing, as opposed to grinding, which uses larger diameter abrasives but causes more surface damage. On the chemical side, the etchant may be potassium hydroxide or ammonium hydroxide, for silicon or silicon dioxide, respectively. For metals such as copper, reactions usually start with an oxidation of the metal from the water in the slurry. Various additives may be found in slurries, to balance their ph, to establish wanted flow characteristics, and for other reasons.

Cleaning of the pad 204 is important between successive uses of the pad 204. The pad 204, for instance, may be a diamond disk, a type of pad that uses industrial diamonds to achieve good planarization of a semiconductor wafer. Diamonds on the pad 204 may become loose. If these diamonds are not washed away from the pad 204, they have great potential to scratch the semiconductor wafer that is being planarized, ruining the semiconductor wafer. The cleaning of the pad 204 between polishings is known as dressing the pad 204.

FIG. 3 shows a conventional system 300 used to clean, or dress, the pad 204 between successive uses. The pad 204 sits on a turntable 302, that rotates as indicated by the arrow 304. A dresser 308 rotates in the same direction on a part of the pad 204, via an arm 306, as indicated by the arrow 312. Deionized water (DIW) is fed through a tube 310 onto the pad 204 at its center 310. The DIW is thus the dressing solution used by the dresser 308 to clean the pad 204. As the DIW is pumped onto the pad 204, the pad 204 rotates, and the dresser 308 itself rotates on the rotating pad 204. The system 300 is specifically one available from Ebara Technologies, Inc., of Sacramento, Calif.

A shortcoming of the conventional system 300 is that at least occasionally it is insufficient to sweep away loose diamonds from the pad 204. This means that the loose diamonds remain present on the pad 204 the next time the pad 204 is used for CMP, it is likely to scratch the semiconductor wafer being polished, effectively ruining the semiconductor wafer. The DIW as used in the system 300 is particularly insufficient to clean loose diamonds from the pad 204.

Therefore, there is a need for a pad cleaning system that overcomes these problems. Specifically, there is a need for a pad cleaning system that effectively sweeps away loose diamonds from a pad. There is a need for such a pad cleaning system that prevents subsequent scratching of semiconductor wafers when the pad is used again for polishing. For these and other reasons, there is a need for the present invention.

SUMMARY OF THE INVENTION

The invention relates to a high-pressure pad cleaning system that can be used in conjunction with semiconductor device fabrication tools that utilize pads, such as chemical-mechanical polishing (CMP) tools. A system of the invention includes a turntable, a first outlet, a second outlet, and a dresser. A pad used in semiconductor device fabrication is placed on the turntable, where the turntable rotates in a first direction. The first outlet supplies a dressing solution, such as deionized water (DIW) onto the pad at a first pressure, substantially at a single point on the center of the pad. The second outlet supplies the dressing solution onto the pad at a second pressure greater than the first pressure, substantially at a radial line from the center of the pad to the edge of the pad at an angle to the pad in a direction opposite to the first direction. The angle may be forty-five degrees. The dresser is positioned over and touches the pad to clean the pad by rotating against it in a second direction.

Embodiments of the invention provide for advantages over the prior art. Unlike conventional pad cleaning systems that use only a single outlet to supply dressing solution, the inventive pad cleaning system uses two outlets, where the second outlet supplies dressing solution at a pressure greater than the first outlet. Furthermore, unlike conventional systems that supply the dressing solution at a single point in the center of the pad, the inventive system supplies the dressing solution along the radius of the pad—that is, along a radial line of the pad—at an angle to the pad, and in a direction opposite to the rotation of the pad. As a result of one or more of these aspects of the invention, cleaning of the pad is superior to that in the prior art. In the case of pads having loose diamonds, it has been found that such diamonds are more likely swept away, reducing future damage to semiconductor wafers by scratching from the diamonds. Other advantages, embodiments, and aspects of the invention will become apparent by reading the detailed description that follows, and by referencing the attached drawings.

BRIEF DESCRIPTION OF THE DRAWINGS

FIG. 3 is a diagram of a conventional pad cleaning system, according to the prior art, and that does not completely clean loose debris, such as loose diamonds, from the pad.

FIG. 4 is a diagram of a pad cleaning system according to an embodiment of the invention that utilizes a second outlet of dressing solution at a higher pressure than a first outlet of dressing solution to clean the pad.

FIGS. 5A and 5B are front-view and side-view diagrams, respectively, of the system of FIG. 4, according to an embodiment of the invention, and that show in particularity how the second outlet of dressing solution supplies the solution along a radial line on the pad at an angle to the pad.

DETAILED DESCRIPTION OF THE INVENTION

Figure 1A:
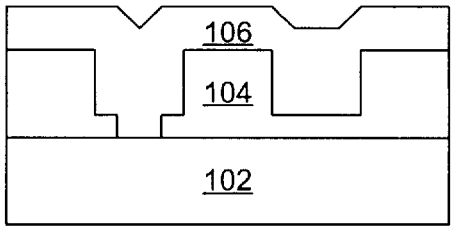
FIGS. 1A and 1B are diagrams showing an example chemical mechanical polishing (CMP) semiconductor fabrication operation.
Figure 1B:
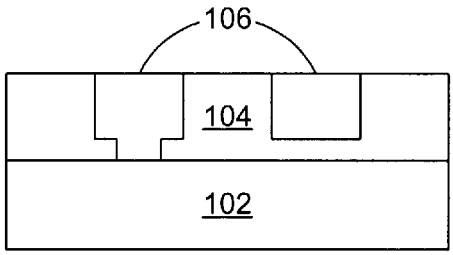
Figure 2:
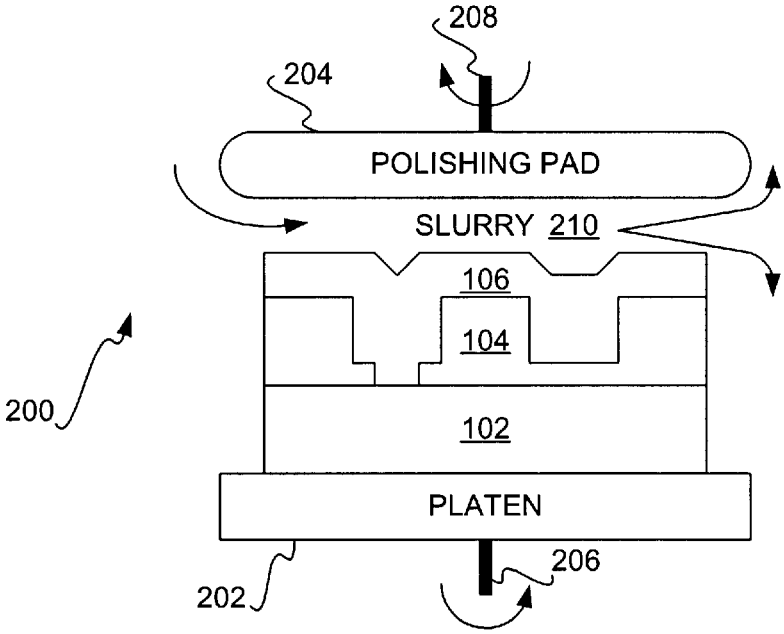
FIG. 2 is a diagram of an example CMP semiconductor fabrication system, in conjunction with which embodiments of the invention can be practiced.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims. For instance, whereas the invention is substantially described in relation to a semiconductor fabrication chemical-mechanical polishing (CMP) tool, it is applicable to other semiconductor fabrication tools as well.

FIG. 4 shows a system 400 according to an embodiment of the invention. The system 400 includes a chemical-mechanical polisher (CMP) 402. The CMP 402 has fed therein slurry 404, as well as compressed air (CDA) 408 and deionized water (DIW) 406. The DIW 406 is more generally a dressing solution. A splitter valve 410 sends the CDA 408 to the combiner 412, where it is used to pressurize the DIW 408. A first outlet 414 supplies the pressurized DIW 406 at substantially a single point on the center of the pad 418. By comparison, a second outlet 416 supplies pressurized DIW 420 onto the paid 418 at a radial line extending from the center of the pad 418 to its edge, at preferably a forty-five degree angle to the pad 418, in a direction opposite to that which the pad 418 is rotating.

The DIW 420 supplied by the outlet 416 is pressurized to a pressure greater than that to which the DIW 406 supplied by the outlet 414 is pressurized. This is accomplished by use of a pressure booster box 422. A splitter valve 424 supplies the CDA 408 to a combiner 426, which combines the CDA 408 with the CDA 428. The combined CDA is fed into an air pressure regulator 430, which regulates the pressure of the combined CDA. This pressured-regulated combined CDA is then fed into a bellow pump 432, into which the DIW 420 is also fed to pressurize the DIW 420. The pressurized DIW 420 is further pressurized via the CDA 408 fed from the splitter valve 424 to the combiner 434, and then is supplied onto the pad 418 via the outlet 416.

FIGS. 5A and 5B show a front view and a side view, respectively, of the system 400 of FIG. 4, with additional components of the system 400 not shown in FIG. 4, and with some components that are shown in FIG. 4 omitted. The pad 418 sits on a turntable 502 that rotates in a first direction indicated by the arrow 508. A dresser 506 rotates according to a second direction indicated by the arrow 516 by virtue of its attachment to an arm 504, as the pad 418 itself rotates. As shown in FIG. 5A, the first direction and the second direction are the same, although this is not necessarily the case. A nozzle 514 may encompass both the outlet 414 and the outlet 416.

As best shown in FIG. 5B, the outlet 414 supplies the pressurized DIW 406 onto a single point at the center of the pad 418, whereas the outlet 416 supplies the pressurized DIW 420 radially from the center of the pad 418 to its edge, in a direction opposite to that which the pad 418 is rotating. As best shown in FIG. 5A, the outlet 416 supplies the pressurized DIW 420 at an angle, preferably substantially forty-five degrees, to the pad 418. The higher pressure of the DIW 420, compared to the pressure of the DIW 406, in addition to the radial nature of the spraying or supplying of the DIW 420 onto the pad 418, and its being supplied at an angle of forty-five degrees to the pad 418 opposite of the rotation of the pad 418, preferably all contribute to the superior cleaning action of the system 400.

Figure 6:
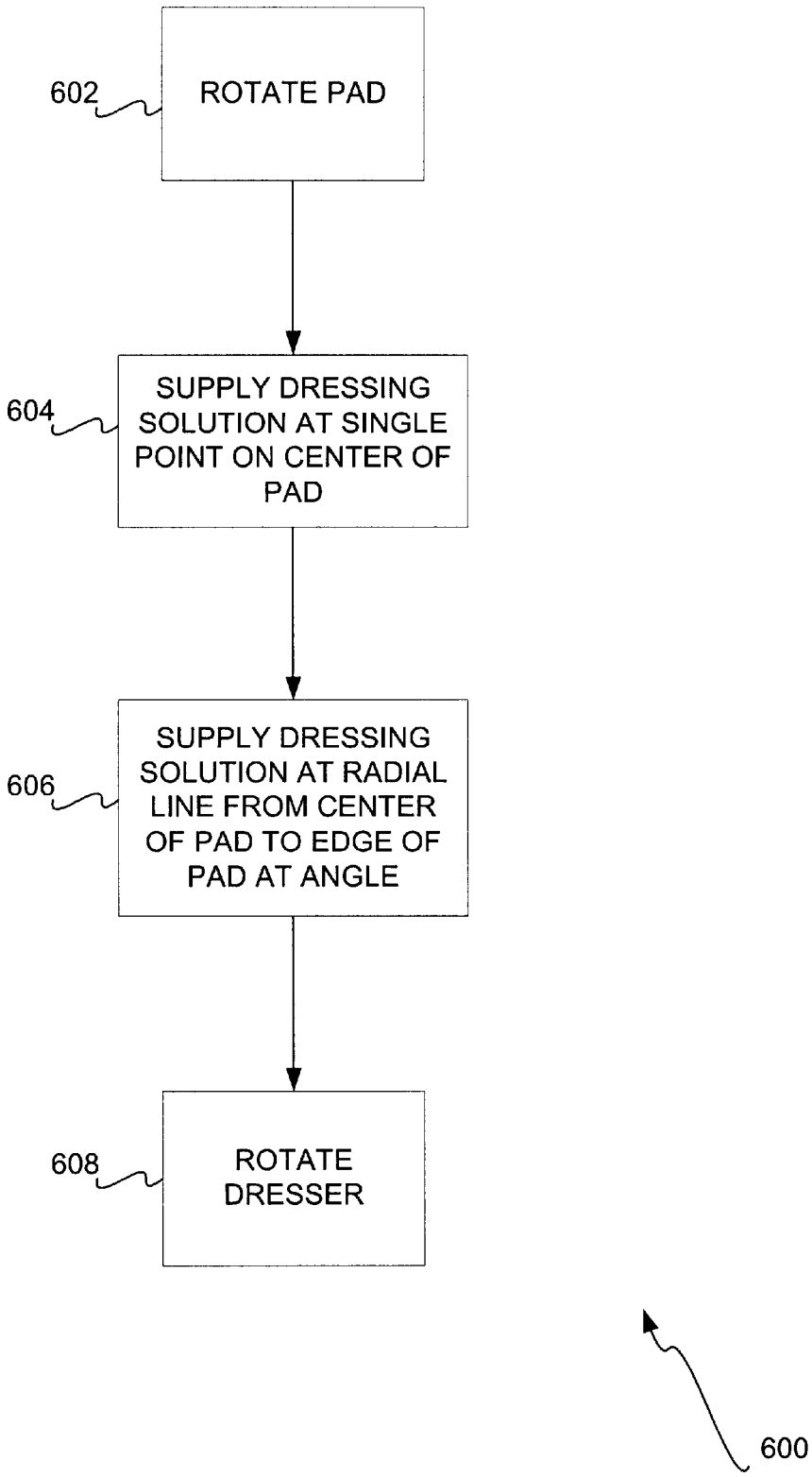
FIG. 6 is a flowchart of a method according to an embodiment of the invention, highlighting how pad cleaning can be accomplished utilizing two jettings of dressing solution.

FIG. 6 shows a method 600 that summarizes the cleaning action of an embodiment of the invention. The method 600 can be utilized in conjunction with the system 400 that has been described. First, a pad used in semiconductor device fabrication is rotated in a first direction (602). Dressing solution, such as DIW, is supplied substantially at a single point on the center of the pad, at a first pressure (604). The dressing solution is also supplied substantially at a radial line from the pad's center to its edge, at an angle to the pad and at a second pressure greater than the first pressure (606). The angle is preferably forty-five degrees. Finally, a dresser positioned over and touching the pad is rotated in a second direction to clean the pad (608). The second direction may be the same as or opposite to the first direction.

It is noted that, although specific embodiments have been illustrated and described herein, it will be appreciated by those of ordinary skill in the art that any arrangement is calculated to achieve the same purpose may be substituted for the specific embodiments shown. This application is intended to cover any adaptations or variations of the present invention. For example, whereas the invention is substantially described in relation to a semiconductor fabrication chemical-mechanical polishing (CMP) tool, it is applicable to other semiconductor fabrication tools as well. Therefore, it is manifestly intended that this invention be limited only by the claims and equivalents thereof.

What is claimed is:

1. A method comprising:

rotating a pad used in semiconductor device fabrication in a first direction;

supplying a dressing solution substantially at a single point on a center of the pad at a first pressure;

supplying a dressing solution substantially at a radial line from the center of the pad to an edge of the pad at an angle to the pad at a second pressure greater than the first pressure; and, rotating a dresser positioned over and touching the pad in a second direction to clean the pad.

2. The method of claim 1, wherein the angle is substantially forty-five degrees.

3. The system of claim 1, wherein the dressing solution is deionized water (DIW).

4. The system of claim 1, wherein the second direction is equal to the first direction.

5. The system of claim 1, where in the pad is used in chemical-mechanical polishing (CMP) of a semiconductor wafer.

6. A system comprising:

a pad used in semiconductor device fabrication;

a turntable on which the pad is placed, the turntable rotatable in a first direction;

a first outlet supplying a dressing solution onto the pad at a first pressure, substantially at a single point on a center of the pad;

a second outlet supplying the dressing solution onto the pad at a second pressure greater than the first pressure, substantially at a radial line from the center of the pad to an edge of the pad at an angle to the pad in a direction opposite to the first direction; and, a dresser positioned over and touching the pad to clean the pad by rotating against the pad in a second direction.

7. The system of claim 6, wherein the angle is substantially forty-five degrees.

8. The system of claim 6, wherein the dressing solution is deionized water (DIW).

9. The system of claim 6, wherein the second direction is equal to the first direction.

10. The system of claim 6, wherein the pad is used in chemical-mechanical polishing (CMP) of a semiconductor wafer.

11. A system comprising:

a pad used in semiconductor device fabrication;

a turntable on which the pad is placed, the turntable rotatable in a first direction;

a first outlet supplying a dressing solution onto the pad at a first pressure;

a second outlet supplying the dressing solution onto the pad at a second pressure greater than the first pressure, and substantially at a radial line from a center of the pad to an edge of the pad; and, a dresser positioned over and touching the pad to clean the pad by rotating against the pad in a second direction.

12. The system of claim 11, wherein the first outlet supplies the dressing solution substantially at a single point on a center of the pad.

13. The system of claim 11, wherein the second outlet supplies the dressing solution in a direction opposite to the first direction in which the turntable is rotatable.

14. The system of claim 11, wherein the second outlet supplies the dressing solution at substantially a forty-five degree angle to the pad.

15. The system of claim 11, wherein the dressing solution is deionized water (DIW).

16. The system of claim 11, wherein the second direction is equal to the first direction.

17. The system of claim 11, wherein the pad is used in chemical-mechanical polishing (CMP) of a semiconductor wafer.

18. The system of claim 11, further comprising a compressed-air source to pressurize the dressing solution supplied by the first outlet to the first pressure.

19. The system of claim 11, further comprising a booster mechanism to pressurize the dressing solution supplied by the second outlet to the second pressure.

* * * * *